US005641188A

United States Patent [19]

Phillips

[11] Patent Number: 5,641,188

[45] Date of Patent: Jun. 24, 1997

[54] INCLINED OR VERTICAL PARK BAIL DUMP BUCKET

[75] Inventor: Thomas S. Phillips, Bethel Park, Pa.

[73] Assignee: Phillips Mine & Mill, Inc., Pittsburgh, Pa.

[21] Appl. No.: 376,810

[22] Filed: Jan. 23, 1995

[51] Int. Cl.[6] ..... B66C 1/28

[52] U.S. Cl. ..... 294/68.27; 294/68.26

[58] Field of Search ..... 294/68.1–68.22, 294/68.26, 68.27; 414/403, 406–409, 425; 220/762, 764, 1.5

[56] References Cited

U.S. PATENT DOCUMENTS

| | | | |
|---|---|---|---|
| 324,484 | 8/1885 | Pipher | 294/68.26 |
| 406,164 | 7/1889 | Focht | 294/68.26 |
| 859,509 | 7/1907 | McDonald | 294/68.26 |
| 866,271 | 9/1907 | Gemmer et al. | 294/68.27 |
| 1,019,327 | 3/1912 | Insley | 294/68.26 |
| 1,343,465 | 6/1920 | Moore . | |
| 1,449,661 | 3/1923 | Forsythe . | |
| 1,758,824 | 5/1930 | Coe | 294/68.27 |
| 2,798,758 | 7/1957 | Yakopec | 294/73 |
| 3,230,003 | 1/1966 | McAfoos et al. | 294/73 |
| 3,374,907 | 3/1968 | Phillips et al. | 214/41 |
| 3,658,199 | 4/1972 | Owen, Jr. | 414/406 |
| 4,070,060 | 1/1978 | Howard | 414/425 |

OTHER PUBLICATIONS

Phillips Mine & Mill Inc. Advertisement, Phillips Junior Automatic Dumping Buckets dated 1980.

*Primary Examiner*—Dean Kramer

*Attorney, Agent, or Firm*—Armstrong, Westerman, Hattori, McLeland & Naughton

[57] ABSTRACT

An automatic dump bucket has a bail which can rest in an inclined position or a vertical position, the bail of the dump bucket pivotable about pivot pins that are not secured to the side wall of the bucket but which are disposed in a bore in a pivot pin support plate on the side wall of the bucket, in a pivot pin aperture in a side wall of an enclosure bracket and trapped by a pivot pin locking plate. The pivot pin and bail contact area can be lubricated by forcing a lubricant through an opening in the pivot pin locking plate and a passageway formed in the pivot pin. The dump bucket also has fork lift channels and roll-over blocking channels and, when dumped, assumes a position beyond a parallel position with the bail.

16 Claims, 5 Drawing Sheets

INCLINED OR VERTICAL PARK BAIL DUMP BUCKET

FIELD OF THE INVENTION

The present invention relates to a dump bucket used to transfer material from one location to another using a derrick, lifting crane, or the like, and more specifically to a dump bucket having a bail which is in inclined position or optionally in vertical position when at rest or parked, and allows complete dumping of the contents of the bucket when tipped.

BACKGROUND OF THE INVENTION

Dump buckets have long been used to transfer material such as scrap metal and the like from a collection point for the scrap metal to an unloading station where the contents are dumped. The bucket is normally formed from metal and has a bottom, side walls, rear wall and a front wall that is inclined so as to permit dumping, by sliding, of the contents from over the front wall by lifting the rear portion of the bucket. A bail is secured to the bucket by which the bucket may be lifted by a crane hook for transfer of the bucket from a scrap collection station to a dumping station. In automatic dump buckets, the bail is locked in a vertical position for movement of the bucket by a crane to prevent unintentional tipping of the dump bucket from a horizontal transfer position.

One example of an automatic safety dumping bucket is illustrated in U.S. Pat. No. 3,230,003, where trunions, rigidly mounted on the bucket side wall, are slidably and rotatably received within slots extending along the sides of a U-shaped bail, with the slots located at the ends of the bail so as to permit the bail to be rotated about and have limited radial movement relative to the trunions.

Another automatic dump bucket is described in U.S. Pat. No. 3,374,907, to James M. Phillips and Alfred D. Parke, Jr. where pivot pins are attached to the side of a bucket and to a bracket also attached to the side of the bucket and the lifting bail is connected to the bucket in a manner such that when the bucket is at rest, or parked on the ground, the bail will swing rearwardly in only a limited arc to an inclined position. While this type of automatic dump bucket has found extensive use, there are certain features lacking from such a construction. For example, with the pivot pins attached to the side walls of the bucket, such as by welding, a possibility exists of the pivot pins shearing from the side wall. Also, there are situations which arise where the inclined position of the bail at rest can cause difficulties, and it would be beneficial to have an option where a bail could be maintained in a vertical position at rest, when desired.

SUMMARY OF THE INVENTION

The present invention provides an automatic dump bucket where the pivot pins for the bail of the bucket are not required to be welded to the side wall of a bucket and where provision is made for vertical positioning of the bail, at rest, as well as in inclined position, if desired.

The automatic dump bucket has a bucket with a bottom wall, side walls, rear wall and inclined front wall, and a bail which extends across the bucket and is slidingly and pivotally attached thereto. The bail has two legs with slots adjacent the lower portion thereof and an abutment member which is adapted to abut an abutment on the side wall of the bucket. A pin support plate is affixed to the side wall of the bucket and has a bore therein, and an enclosure bracket is provided with an enclosure bracket side wall spaced from the pin support plate. A pivot pin fits through the slot of the bail leg and is retained in the bore of the pin support plate and an aperture in the side wall of the enclosure bracket by a pin locking plate secured to the outer surface of the side wall of the enclosure bracket.

The enclosure bracket preferably has the side wall thereof spaced from a side wall of the bucket by a front wall and a rear wall, with a top flange extending rearwardly from the front wall. The rear wall forms a blocking face which enables the bucket to pivot to a position beyond a parallel position relative to the bail. A lubricant opening is provided in the pin locking plate which communicates with a passageway formed in the pivot pin through which lubricant may be injected so as to lubricate the contact area of the pivot pin and the leg of the bail.

BRIEF DESCRIPTION OF THE DRAWINGS

The present invention will become more readily apparent by reference to the drawings which illustrate embodiments thereof and wherein.

DETAILED DESCRIPTION

Figure 1:
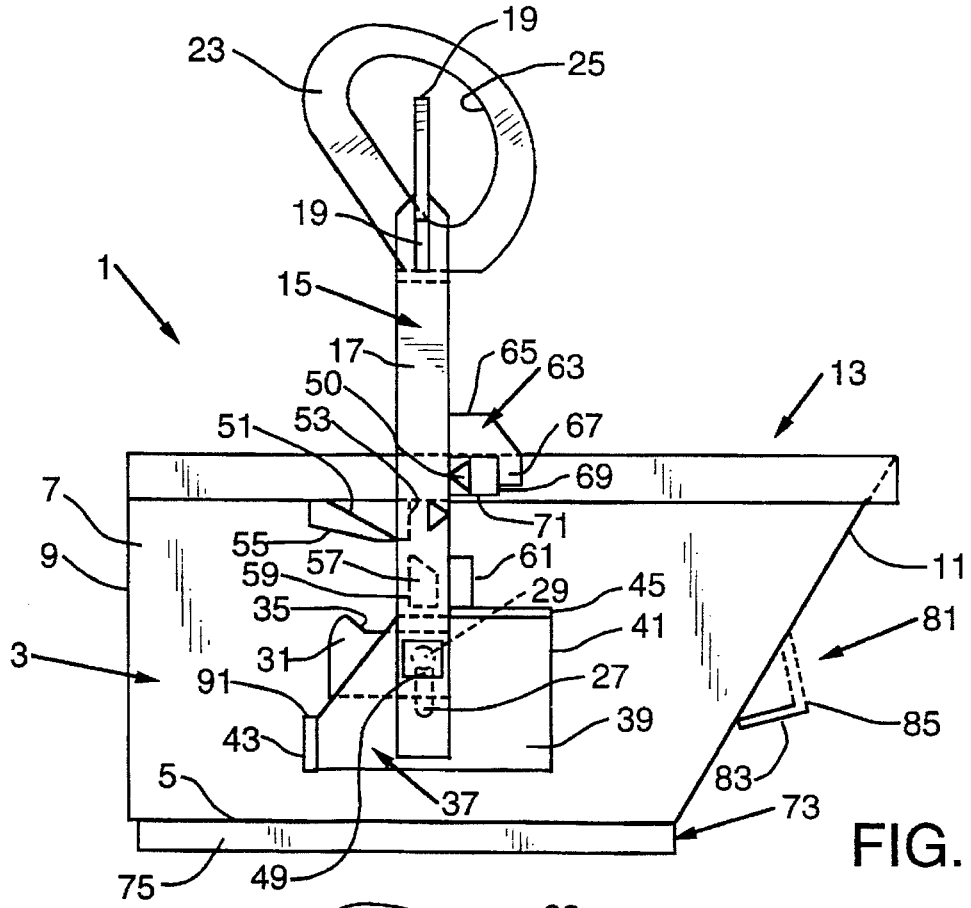
FIG. 1 is a side elevational view of the automatic dump bucket of the present invention with the bail of the bucket in vertical, locked, rest position.
Figure 2:
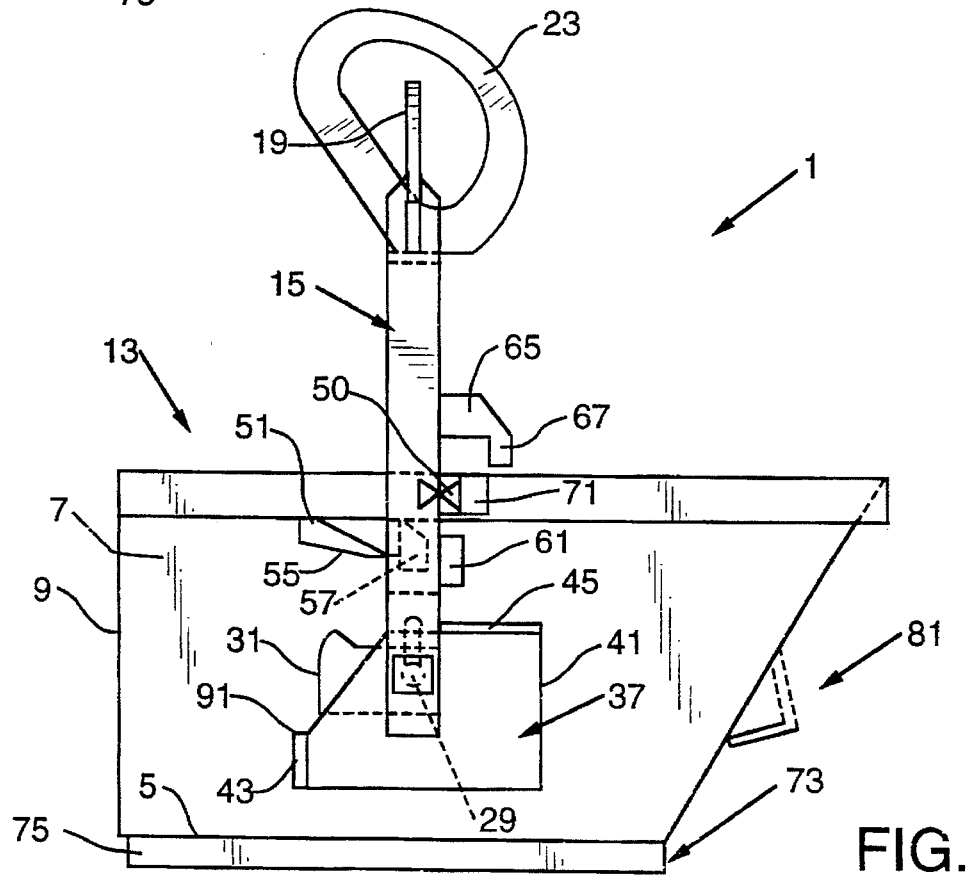
FIG. 2 is a view of the automatic dump bucket of FIG. 1 with the bail of the bucket in position as lifted by a clamp or hook.

Referring now to the drawings, the inclined or vertical park bail dump bucket 1 is shown having a bucket 3 that is formed with a bottom wall 5, pair of side walls 7, rear wall 9 and a front wall 11 which extends upwardly and outwardly from the bottom wall 5, the bucket 3 having an open top 13. The dump bucket 3 has a bail 15 which is comprised of a pair of legs 17 which extend downwardly from a cross bar 19 extending across the open top 13 of the bucket 3. The cross bar 19 has an opening 21 at the center section thereof for engagement by a hook (not shown) for lifting of the cross bar 19 and consequently the bucket 3. In addition to the opening 21 in the cross bar 19, a pair of ears 23 may be provided one adjacent each end of the cross bar 19, which have tong openings 25 therein for engagement and lifting of the cross bar 19 and consequently the bucket 3.

Adjacent the lower end of each of the legs 17 there is formed a pivot pin slot 27 which encloses a pivot pin 29, adapted to extend perpendicularly outwardly from each side 7 of the bucket 3. A pivot pin support plate 31 is secured to each side wall 7 which has a pivot pin bore 33 formed therein and a rest abutment 35 extending upwardly and rearwardly therefrom. An enclosure bracket 37 is provided on each side wall 7 which has an enclosure bracket side wall 39, enclosure bracket front wall 41 and enclosure bracket rear wall 43, as well as a top flange 45 extending rearwardly from the enclosure bracket front wall 41. A pivot pin aperture 47 is formed in the enclosure bracket side wall 39. The pivot pin 29 is inserted through the pivot pin aperture 47, through pivot pin slot 27 in the leg 17 of the bail and is received in the pivot pin bore 33 of pivot pin support plate 31. A pivot pin locking plate 49 is then secured to the enclosure bracket side wall 39 of enclosure bracket 37 over the pivot pin 39 to trap the pivot pin 29 in place.

Figure 3:
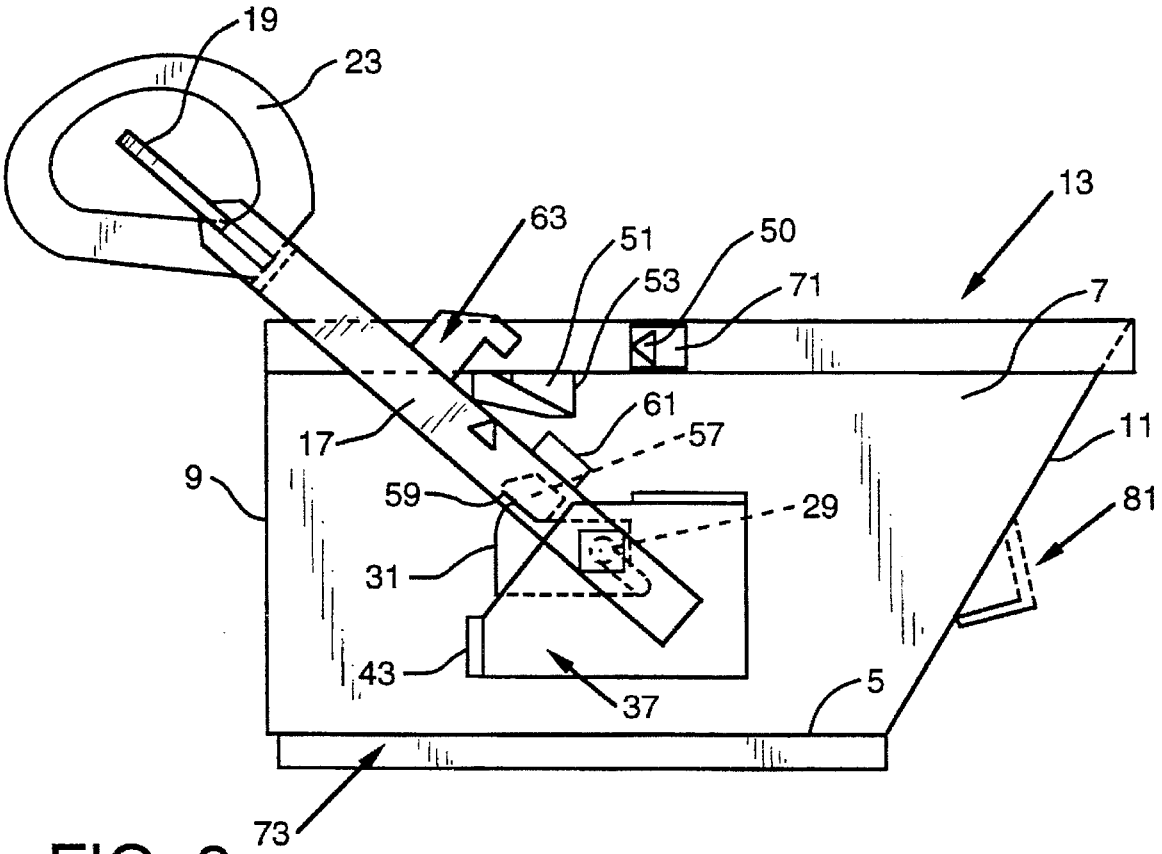
FIG. 3 is a view of the automatic dump bucket of FIG. 1 where the bail is in inclined, at rest, position.

As in the prior art dump bucket of U.S. Pat. No. 3,374,907, the contents of which are incorporated herein, an abutment 50 is provided on the sides 7 of the bucket which is positioned to engage the bail 15 in the vertical position so as to prevent the bail from swinging towards the front 11 of the bucket 3 past a vertical position. Also secured to the side 7 of the bucket 3, in a position which clears the leg 17 of the bail 15 is an abutment 51 having a vertical surface 53 and a bottom inclined surface 55. On the inner surface of the leg 17 facing side wall 7 is secured a cooperating abutment element 57 with a vertical surface 59. On the leg 17, extending towards the front 11 of the bucket 3 is a stop member 61. The abutment 51, cooperating abutment element 57 and stop member 61 are operative as described in U.S. Pat. No. 3,374,907. As in that patent, the bail, as described herein is normally adapted to lie in an inclined position at rest, as illustrated in FIG. 3.

Optionally, if it is desired to provide for vertical positioning of the bail 15 when at rest position, a bail vertical locking member 63 is provided attached to the front of the leg 17 of bail 15 which has a forwardly extending portion 65 and downwardly depending leg 67. The bail vertical locking member is constructed and arranged such that when the bail 15 is lowered from a raised vertical position, the downwardly depending leg 67 will contact the front face 69 of locking abutment 71 and prevent tilting of the bail 15 towards the rear wall 9 of the bucket. The locking of the bail in vertical position is useful when space limitations are a factor, such that the bail does not extend beyond the rear wall 9 of the bucket 3 as when in inclined position. The locked inclined position of the bail is useful when the dump buckets are stored end-to-end, or when the dump bucket is moved, for example, by a conventional fork lift device. In order to provide for lifting and movement of the dump bucket 1 by a fork lift, a pair of fork lift channels 73, each comprising a pair of downwardly depending support legs 75 are secured to the bottom surface 77 of bottom wall 5, the downwardly depending support legs connected by a brace 79, which fork lift channels 73 are spaced apart a distance sufficient such that each one accepts a fork of a fork lift device.

Figure 4:
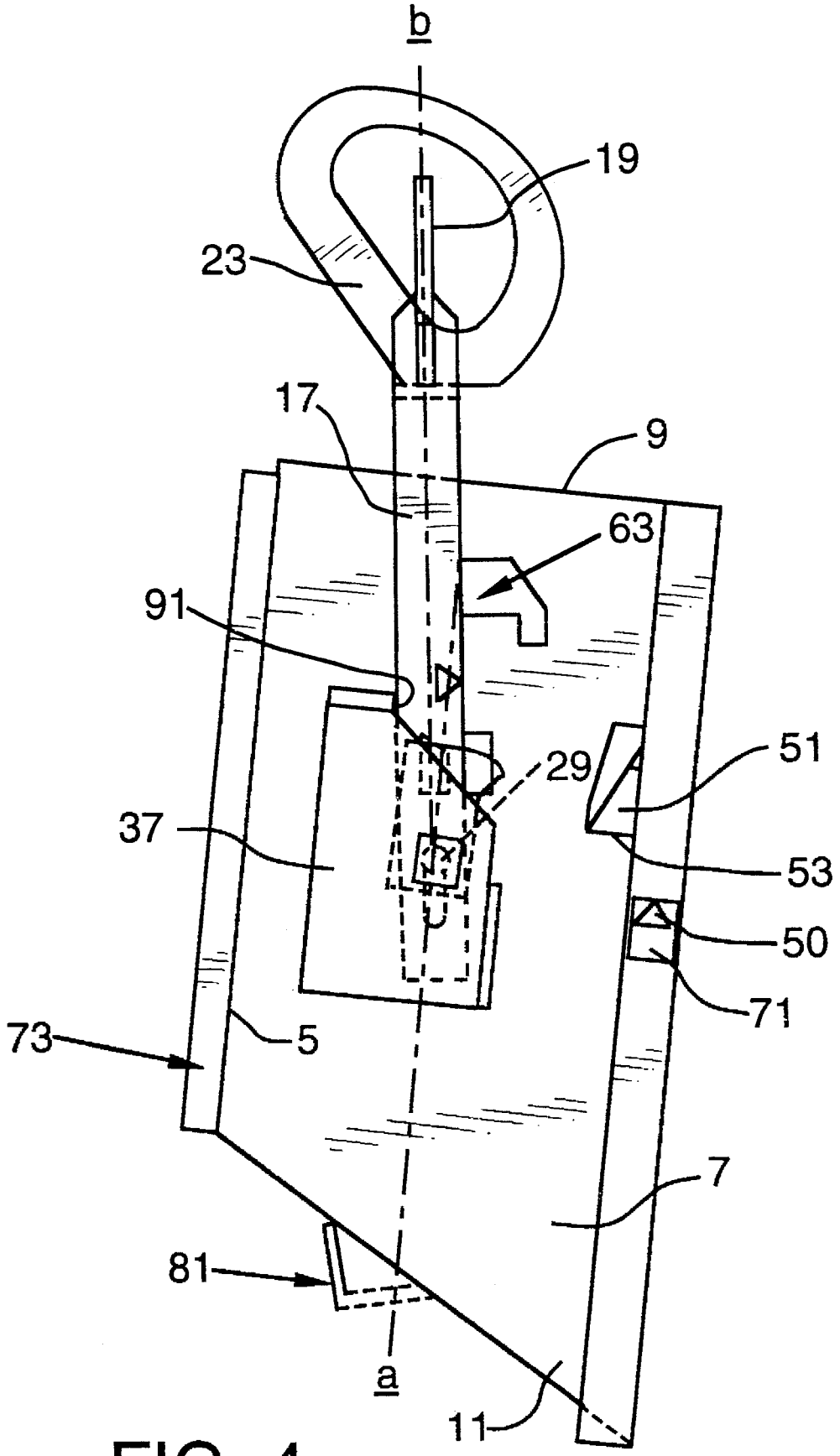
FIG. 4 is a view of the automatic dump bucket of FIG. 1 in full dumping position.
Figure 6:
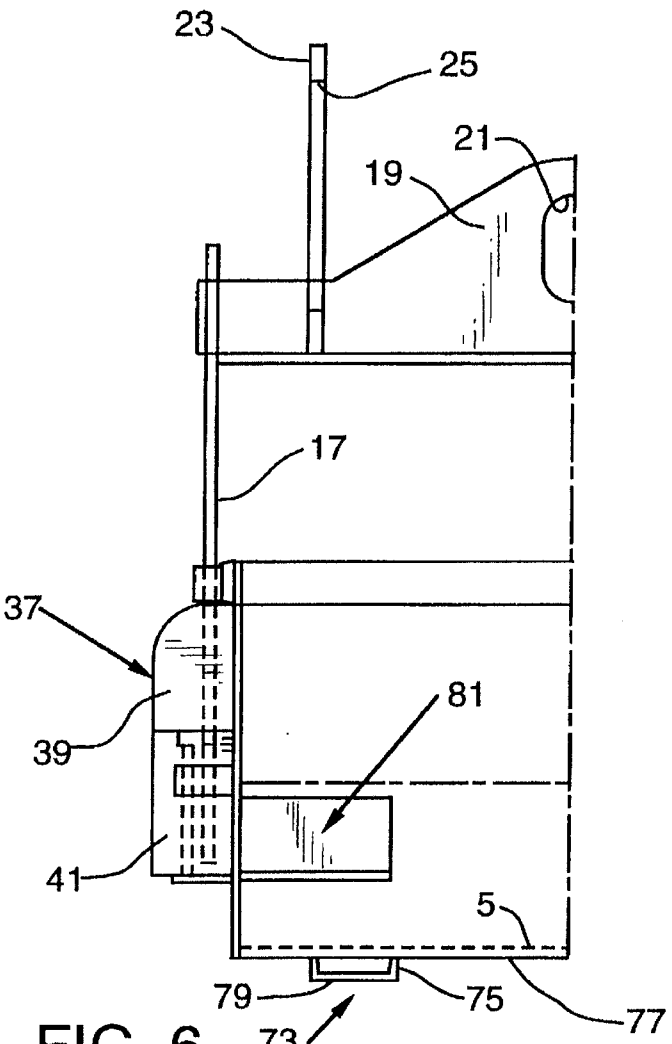
FIG. 6 is a front view of one half of the automatic dump bucket illustrated in FIG. 1, the other half being a mirror image thereof.
Figure 5:
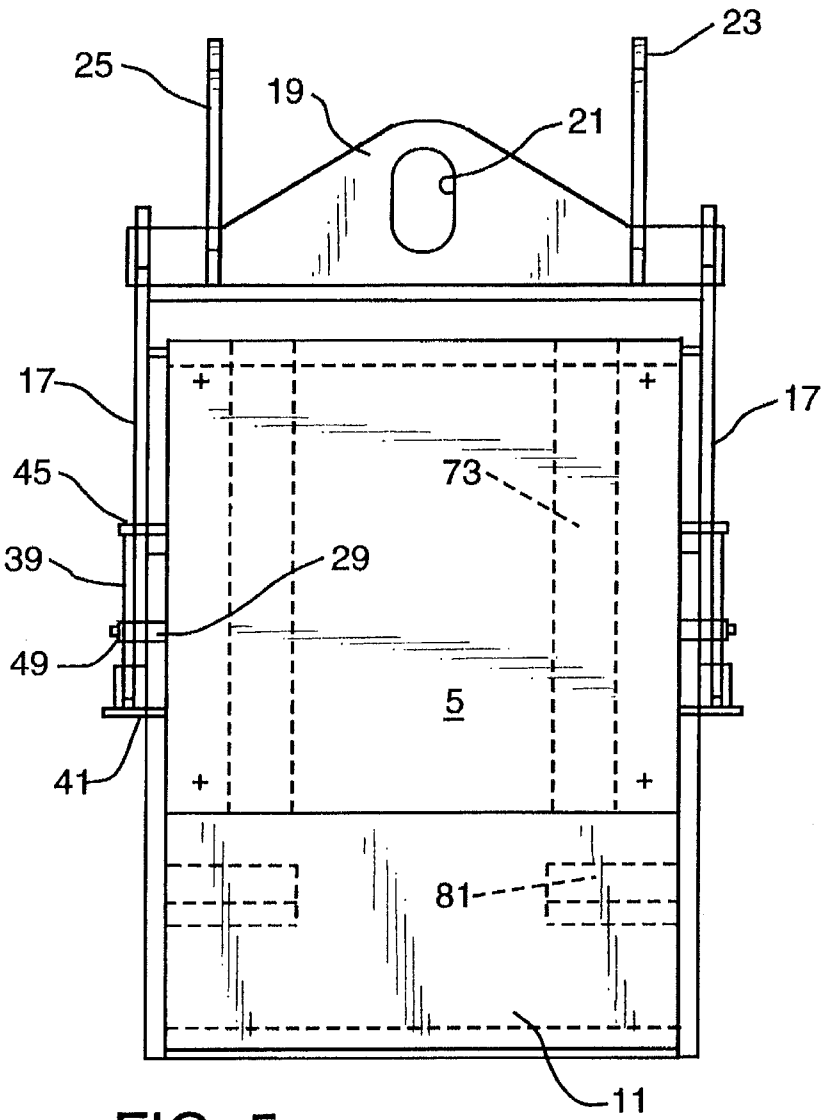
FIG. 5 is a top plan view of the automatic dump bucket illustrated in FIG. 1 with the bail in inclined rest position.
Figure 7:
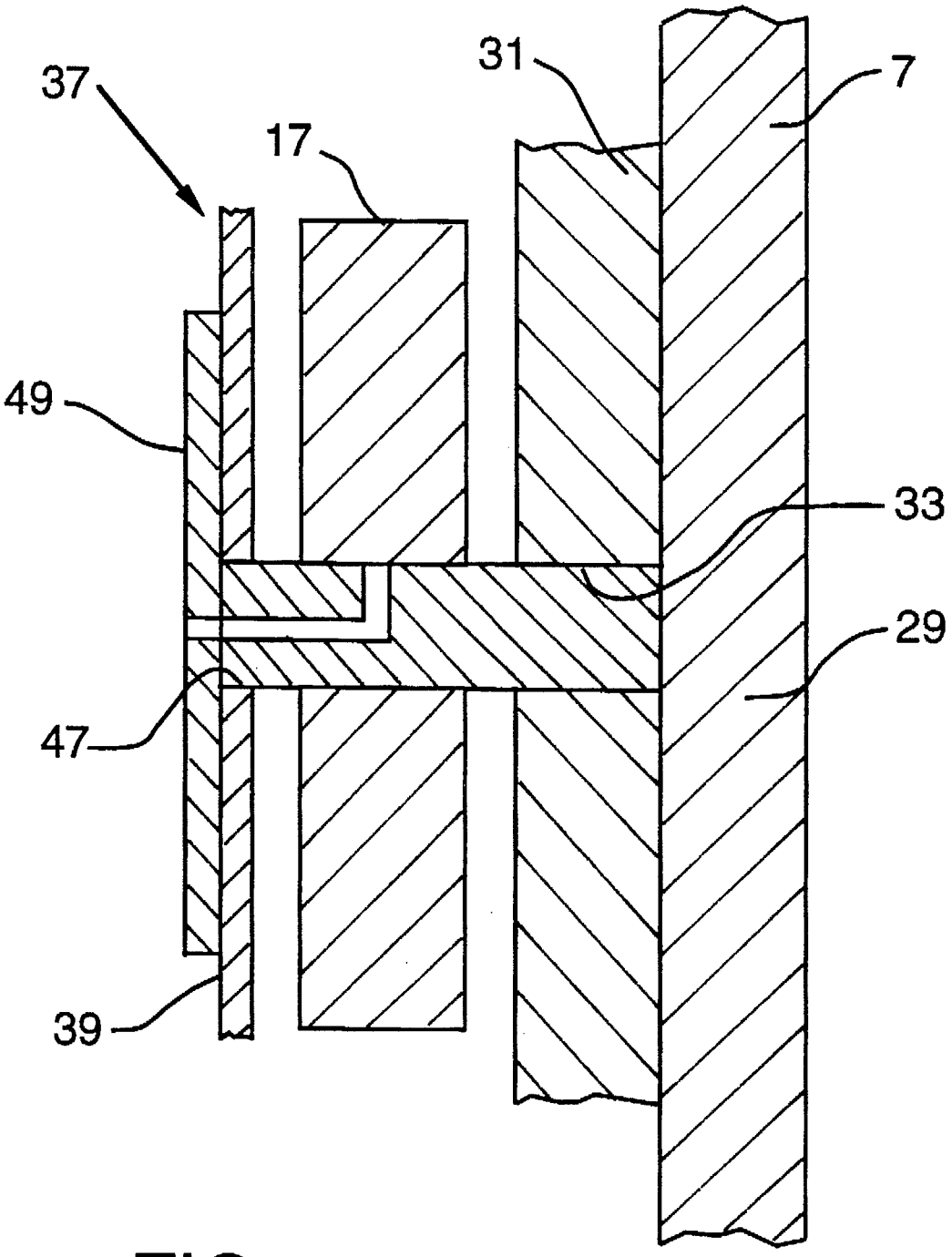
FIG. 7 is an enlarged horizontal cross-sectional view through a pivot pin of the automatic dump bucket illustrated in FIG. 1.

The dump bucket is designed such that the bucket 3, when being dumped, will pivot to a position beyond a parallel position relative to the bail 15, as illustrated in FIG. 4. As shown, a blocking face 91 is provided on the enclosure bracket rear wall 43 which is located so as to enable the bucket 3 to pivot to a position indicated by line a which is beyond a parallel relationship to the bail 15, as indicated by line b, so as to ensure that the entire load in the bucket 3 is dumped.

On the front wall 11 of the bucket 3 is secured a roll-over blocking means 81, illustrated as a pair of spaced outwardly extending channels 83 having a contact edge 85. The roll-over blocking means 81 prevents full tipping of the bucket forwardly, in the event that the front end of the bucket is overloaded relative to the rear end thereof, so as to preclude spillage of the contents of the bucket at an unintentional location when the bucket is at rest on a surface and aid the bucket 3 in returning to the horizontal locked position. Also, at the rear upper portion of each side walls 7, a bail guide member is secured to the wall 7, the bail guide member having an inclined surface so as to provide for smooth passage of the bail 15 from dumping to vertical positions.

What is claimed is:

1. In an automatic dump bucket wherein the bucket has a bottom, side walls, a rear wall and an inclined front wall, over which the contents of the bucket are discharged when the rear end of the bucket is tilted upwardly, the bucket having a bail which extends across the bucket and which bail has two legs, one of each of the legs slidably attached to each of said side walls, with an abutment on each side wall engageable with an abutment member on a respective leg of the bail to prevent pivotal movement of the bucket when the bail is vertically lifted relative to the bucket, with vertical slots in each of said legs, the improvement comprising:

a pivot pin support plate affixed to said bucket side wall, said pivot pin support plate having a bore therein; an enclosure bracket disposed over said pivot pin support plate, said enclosure bracket having an enclosure bracket side wall with an aperture therein, an enclosure bracket front wall, an enclosure bracket rear wall which extends a distance such as to form a blocking face which enables said bracket to pivot to a position beyond a parallel position relative to said bail, and a top flange extending rearwardly from said enclosure bracket front wall; a pivot pin extending through said enclosure bracket side wall and a slot of said leg and disposed in the bore of said pivot pin support plate; and a pivot pin locking plate secured to the enclosure bracket side wall of said enclosure bracket to trap said pivot pin.

2. An automatic dump bucket as defined in claim 1 wherein said pivot pin support plate has a rest abutment extending upwardly and rearwardly therein.

3. An automatic dump bucket as defined in claim 1 including a pair of fork lift channels on the bottom surface of said bottom wall of said bucket.

4. An automatic dump bucket as defined in claim 3 wherein said fork lift channels each comprise a pair of downwardly depending support legs secured to said bottom surface and a brace connecting each said pair of legs.

5. An automatic dump bucket as defined in claim 1 including a roll-over blocking means attached to the front wall of said bucket.

6. An automatic dump bucket as defined in claim 5 wherein said roll over blocking means comprises a pair of spaced outwardly extending channels, each having a contact edge.

7. In an automatic dump bucket wherein the bucket has a bottom, side walls, a rear wall and an inclined front wall, over which the contents of the bucket are discharged when the rear end of the bucket is tilted upwardly, the bucket having a bail which extends across the bucket and which bail has two legs, one of each of the legs slidably attached to each of said side walls, with an abutment on each side wall engageable with an abutment member on a respective leg of the bail to prevent pivotal movement of the bucket when the bail is vertically lifted relative to the bucket, with vertical slots in each of said legs, the improvement comprising:

a pivot pin support plate affixed to said bucket side wall, said pivot pin support plate having a bore therein; an enclosure bracket disposed over said pivot pin support plate, said enclosure bracket having an enclosure bracket side wall with an aperture therein; a pivot pin extending through said enclosure bracket side wall and a slot of said leg and disposed in the bore of said pivot pin support plate; and a pivot pin locking plate secured to the enclosure bracket side wall of said enclosure bracket to trap said pivot pin; and means for directing a lubricant from the outer surface of said pivot pin locking plate to a location between said pivot pin and the leg of said bail.

8. An automatic dump bucket as defined in claim 7 where said means for directing lubricant comprises a lubricant opening through said pivot pin locking plate and a passageway in said pivot pin from an end thereof to sides thereof, said passageway communicating with said lubricant opening.

9. An automatic dump bucket as defined in claim 7 including a pair of fork lift channels on the bottom surface of said bottom wall of said bucket.

10. An automatic dump bucket as defined in claim 9 wherein said fork lift channels each comprise a pair of downwardly depending support legs secured to said bottom surface and a brace connecting each said pair of legs.

11. An automatic dump bucket as defined in claim 7 including a roll-over blocking means attached to the front wall of said bucket.

12. An automatic dump bucket as defined in claim 11 wherein said roll over blocking means comprises a pair of spaced outwardly extending channels, each having a contact edge.

13. In an automatic dump bucket wherein the bucket has a bottom, side walls, a rear wall and an inclined front wall, over which the contents of the bucket are discharged when the rear end of the bucket is tilted upwardly, the bucket having a bail which extends across the bucket and which bail has two legs, one of each of the legs slidably attached to each of said side walls, with an abutment on each side wall engageable with an abutment member on a respective leg of the bail to prevent pivotal movement of the bucket when the bail is vertically lifted relative to the bucket, with vertical slots in each of said legs, the improvement comprising:

a pivot pin support plate affixed to said bucket side wall, said pivot pin support plate having a bore therein; an enclosure bracket disposed over said pivot pin support plate, said enclosure bracket having an enclosure bracket side wall with an aperture therein, an enclosure bracket front wall, an enclosure bracket rear wall, and a top flange extending rearwardly from said enclosure bracket front wall; a pivot pin extending through said enclosure bracket side wall and the slot of said leg and disposed in the bore of said pivot pin support plate, a pivot pin locking plate secured to the enclosure bracket side wall of said enclosure bracket to trap said pivot pin; and means for directing a lubricant from an outer surface of the pivot pin locking plate to a location between said pivot pin and the leg of said bail.

14. An automatic dump bucket as defined in claim 13 wherein said means for directing lubricant comprises a lubricant opening through said pivot locking plate and a passageway in said pivot pin from an end thereof to sides thereof, said passageway communicating with said lubricant opening.

15. An automatic dump bucket as defined in claim 13 including a pair of fork lift channels on the bottom surface of the bottom wall of said bucket, each said fork lift channel comprising a pair of downwardly depending support legs secured to said bottom surface and a brace connecting said pair of legs.

16. An automatic dump bucket as defined in claim 13 including a roll-over blocking means attached to the front wall of said bucket.

* * * * *